US006752688B2

(12) United States Patent
Adachi et al.

(10) Patent No.: US 6,752,688 B2
(45) Date of Patent: Jun. 22, 2004

(54) CUTTING SOLUTION SUPPLYING AND CONTROLLING APPARATUS FOR DICING MACHINE

(75) Inventors: Tadashi Adachi, Mitaka (JP); Masayuki Azuma, Mitaka (JP); Takayuki Kaneko, Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 103 days.

(21) Appl. No.: 10/124,715

(22) Filed: Apr. 18, 2002

(65) Prior Publication Data

US 2002/0166909 A1 Nov. 14, 2002

(30) Foreign Application Priority Data

Apr. 19, 2001 (JP) ..... 2001-121284

(51) Int. Cl.[7] ..... B24B 1/00

(52) U.S. Cl. ..... 451/5; 451/60; 451/446; 125/13.01; 125/20

(58) Field of Search ..... 451/5, 60, 446, 451/1; 125/13.01, 20

(56) References Cited

U.S. PATENT DOCUMENTS 5,857,893 A * 1/1999 Olsen et al. ..... 451/5
6,161,533 A * 12/2000 Katsumata et al. ..... 125/21
6,183,341 B1 * 2/2001 Melcer
6,244,929 B1 * 6/2001 Russ et al. ..... 451/5

FOREIGN PATENT DOCUMENTS

JP 07-169717 7/1995
JP 08-111507 4/1996

* cited by examiner

*Primary Examiner*—George Nguyen
(74) *Attorney, Agent, or Firm*—Nixon Peabody LLP; David S. Safran

(57) ABSTRACT

In the cutting solution supplying and controlling apparatus for a dicing machine, a flow rate adjusting device is provided in addition to a regulator as the pressure adjusting device. The flow rate adjusting device has a flow rate controller, which controls a proportional solenoid valve according to a signal applied from a flow rate sensor as a feedback signal. Thus, even if the pressure of the water supplied from the water supply equipment of the factory changes, the flow rates of the cutting solution and the coolant are maintained. Moreover, the flow rates can be easily adjusted according to the type of work to be processed.

3 Claims, 4 Drawing Sheets

CUTTING SOLUTION SUPPLYING AND CONTROLLING APPARATUS FOR DICING MACHINE

BACKGROUND OF THE INVENTION

1. Field of the Invention

The present invention relates to an apparatus for supplying and controlling cutting solution for a dicing machine, and more specially, to a cutting solution supplying and controlling apparatus for a dicing machine which has a flow rate adjusting device.

2. Description of the Related Art

FIG. 4 is a block diagram of a cutting solution supplying and controlling apparatus for a dicing machine in a related art. In this apparatus, water supplied from a water supply equipment 60 of the factory is divided into a cutting solution, which is applied to the edge of a blade (a cutting edge), and a coolant (F) and a coolant (R), which are respectively applied to a front side and a rear side of the blade. Each of the divided water supply lines comprises a regulator 31 for adjusting pressure of the water, a solenoid valve 71 for halting the flow of the water, a flow rate regulating throttle 73 for adjusting the flow rate of the water, and a check valve 35 for permitting the water to flow in one direction only. The water is supplied through the lines and applied to a processing part through applying nozzles (a cutting solution nozzle 36 and coolant nozzles 37). To turn on and off the supply of the water, the valve switch 72 opens and closes the solenoid valve 71 according to signals applied from a main controller 50 of the dicing machine.

In this cutting solution supplying and controlling apparatus, the flow rate of the cutting solution or the coolant is set with the flow rate regulating throttle 73. The flow rate regulating throttle 73 is a manual throttle that is manually set by the operator and is fixed until adjusted again by the operator, and the flow rate hence fluctuates when the pressure of the supplied water changes.

The water supply equipment 60 of the factory supplies water to many apparatuses, and a supplying capacity of the water supply equipment 60 is not enough in many cases. Then, the pressure of the water supplied from the water supply equipment 60 is easily affected by a state of operation in the variety of apparatuses. If the pressure of the water supplied from the water supply equipment 60 falls, the regulator 31 cannot adjust the pressure to the set value, and the flow rate is reduced as a result. The flow rates of the cutting solution and the coolant greatly influence the processing quality in the processing of the work by the dicing machine, and the processing quality is seriously affected by the fluctuation of the flow rates in the cutting solution supplying and controlling apparatus.

If the operator adjusts the flow rates of the cutting solution and the coolant with the cutting solution supplying and controlling apparatus according to the type of the work to be processed, the operator must perform troublesome operations to change the setting of the flow rate regulating throttles 73.

In a case where a semiconductor wafer is processed in the dicing machine, when the wafer that has been grooved in a direction (CH-1) is further grooved in another direction (CH-2) perpendicular to the CH-1 direction, it is preferable to increase the flow rate of the cutting solution in order to prevent contamination from accumulating in the processed grooves in the CH-1 direction; however, it is impossible in the cutting solution supplying and controlling apparatus.

SUMMARY OF THE INVENTION

In view of the foregoing, it is an object of the present invention to provide a cutting solution supplying and controlling apparatus for a dicing machine in which the flow rates of the cutting solution and the coolant do not change in the case where the pressure of the water supplied from the water supply equipment of the factory changes, the flow rates can be easily adjusted according to the type of work to be processed, and the flow rates for the CH-1 direction and the CH-2 direction can be automatically changed.

In order to achieve the above-described object, the present invention is directed to a cutting solution supplying and controlling apparatus for a dicing machine, in which cutting solution is applied to a processing part of the dicing machine, the cutting solution supplying and controlling apparatus comprising: a flow rate adjusting device which adjusts a flow rate of the cutting solution to be supplied, the flow rate adjusting device comprising: a flow rate regulator which regulates the flow rate of the cutting solution to a set flow rate; a flow rate sensor which detects the adjusted flow rate of the cutting solution; and a flow rate controller which controls the flow rate regulator, wherein the flow rate controller controls the flow rate regulator with a detected signal of the flow rate sensor as a feedback signal and maintains the flow rate of the cutting solution to the set flow rate.

According to the present invention, the flow rate adjusting device controls the flow rate regulator with reference to a signal applied from the flow rate sensor as a feedback signal. Thus, even if the pressure of the water supplied from the water supply equipment of the factory changes, the flow rate of the cutting solution can be controlled and maintained to the set flow rate.

Preferably, the flow rate of the cutting solution is automatically set according to type information of a work being processed in the dicing machine.

According to the present invention, the suitable flow rate of the cutting solution for the work to be processed can be set and maintained automatically.

Preferably, the dicing machine performs a first groove processing to groove the work in a first direction and a second groove processing to groove the work in a second direction; the flow rate of the cutting solution is differently set to each of the first processing and the second processing; and the flow rate of the cutting solution is automatically changed according to the direction of the groove processing.

According to the present invention, the flow rate of the cutting solution can be changed automatically according to the directions of the grooving. Thus, contamination does not accumulate in the processed groove.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Hereunder a preferred embodiment of an apparatus for supplying and controlling cutting solution for a dicing machine according to the present invention will be described in detail with reference to the accompanying drawings.

Figure 1:
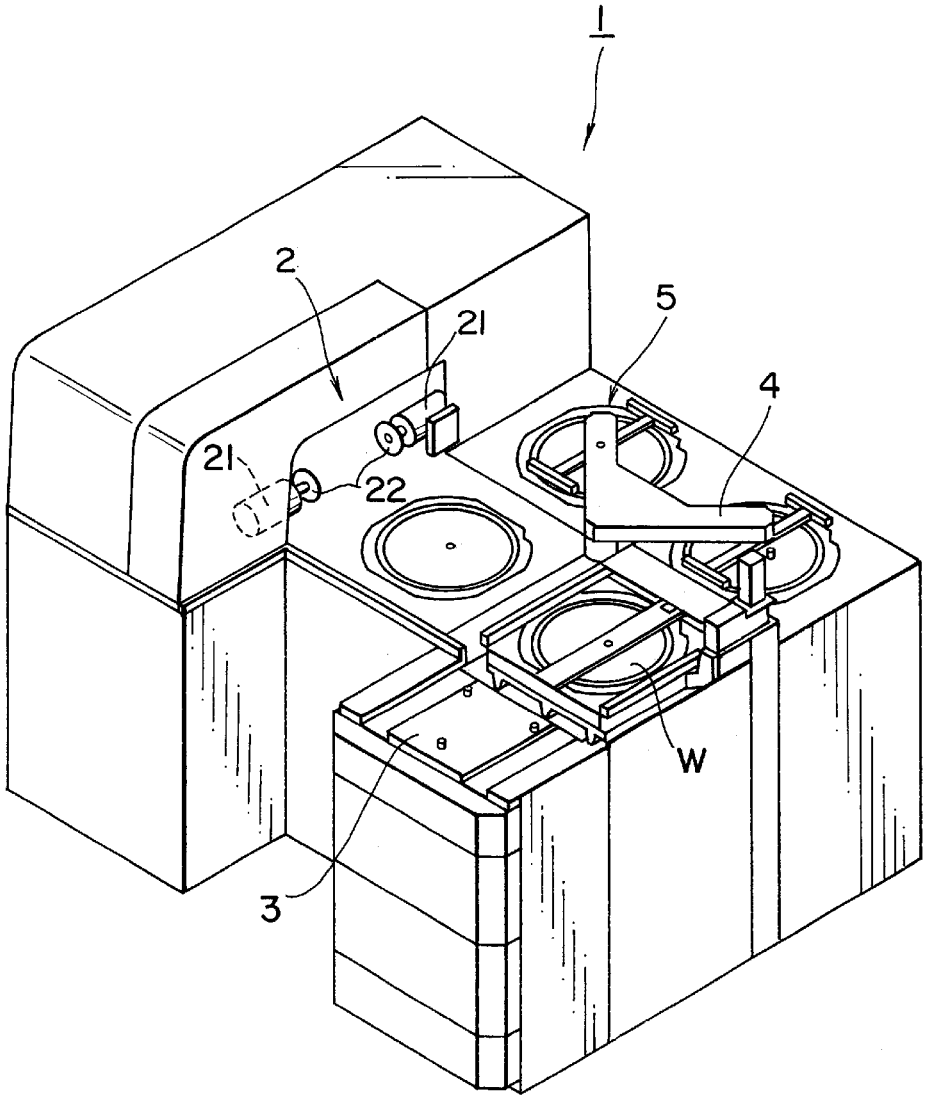
FIG. 1 is a perspective view showing the appearance of a dicing machine.

First, the dicing machine for which the cutting solution supplying and controlling apparatus of the embodiment is used will be described in general. FIG. 1 is a perspective view showing an appearance of the dicing machine 1, which comprises a processing part 2 having spindles 21, to which blades (cutting edges) 22 are attached and high frequency motors are connected; a washing part 5, which spins and washes a processed work W; a load port 3, on which cassettes containing many works W are loaded; a transporting device 4, by which the work W is transported; and the cutting solution supplying and controlling apparatus.

Figure 2:
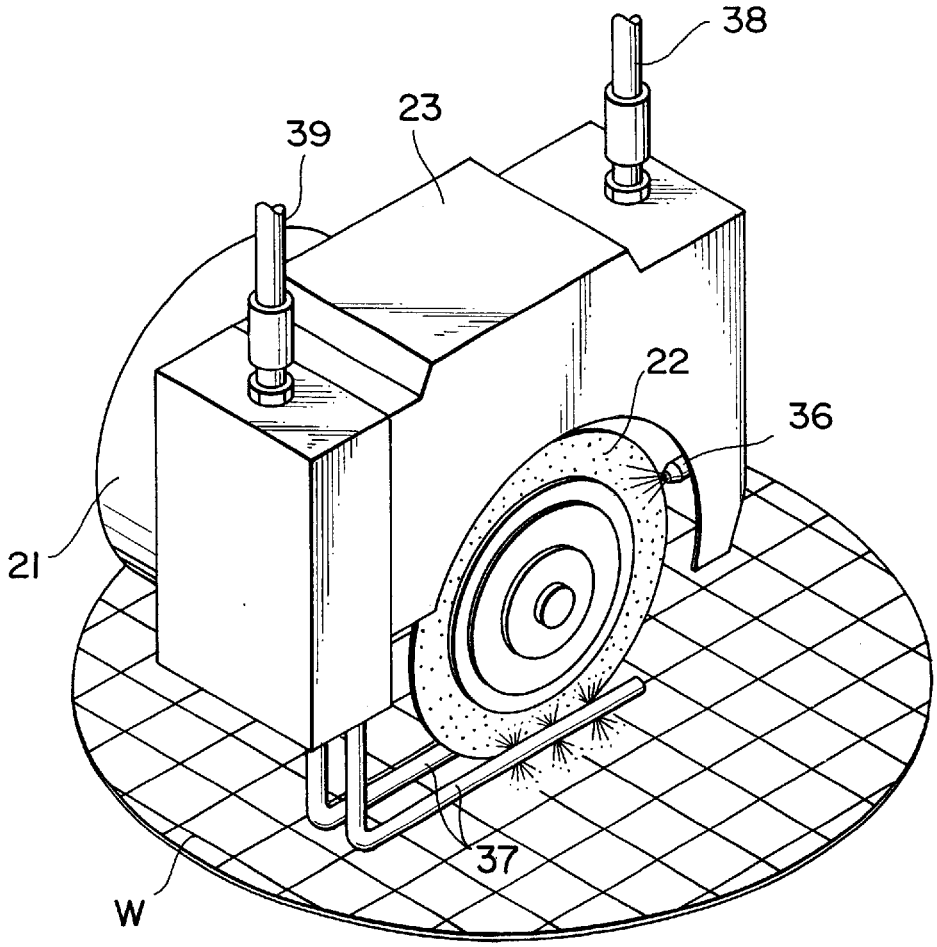
FIG. 2 is an enlarged perspective view showing a cutting part of the dicing machine in FIG. 1.

FIG. 2 is an enlarged view of the processing part 2. The blade 22 is attached to a flange at an end of the spindle 21, in which the high frequency motor is built. The spindle 21 is further provided with a flange cover 23, which covers the flange and the blade 22. A cutting solution nozzle 36, which applies cutting solution to an edge of the blade 22, and a cutting solution supply pipe, through which the cutting solution is supplied to the cutting solution nozzle 36, are attached to the flange cover 23. The cutting solution applied to the edge of the blade 22 is supplied to a processing portion along the blade 22. Moreover, a pair of coolant nozzles 37, which apply coolant to the processing portion, and a coolant supply pipe 39, through which the coolant is supplied to the coolant nozzles 37, are attached to the flange cover 23. The pair of coolant nozzles 37 are arranged in front and rear of the blade 22, respectively. The coolant applied through the pair of coolant nozzles 37 prevents the processing heat from raising the temperature of the blade 22. The cutting solution and coolant also wash scraps generated in the processing away from the surface of the work W, and prevent the work W from being contaminated with the scraps.

In the dicing machine 1, the cassette having many works W is loaded on the load port 3, and the work W is pulled out of the cassette and transported to the processing part 2 by the transporting device 4. After the processes on the work W finishes, the work W is transported to the washing part 5 by the transporting device 4 and is spun and washed. The work W after washing is returned to the cassette as before by the transporting device 4. One work W is thus processed by the dicing machine 1.

Figure 3:
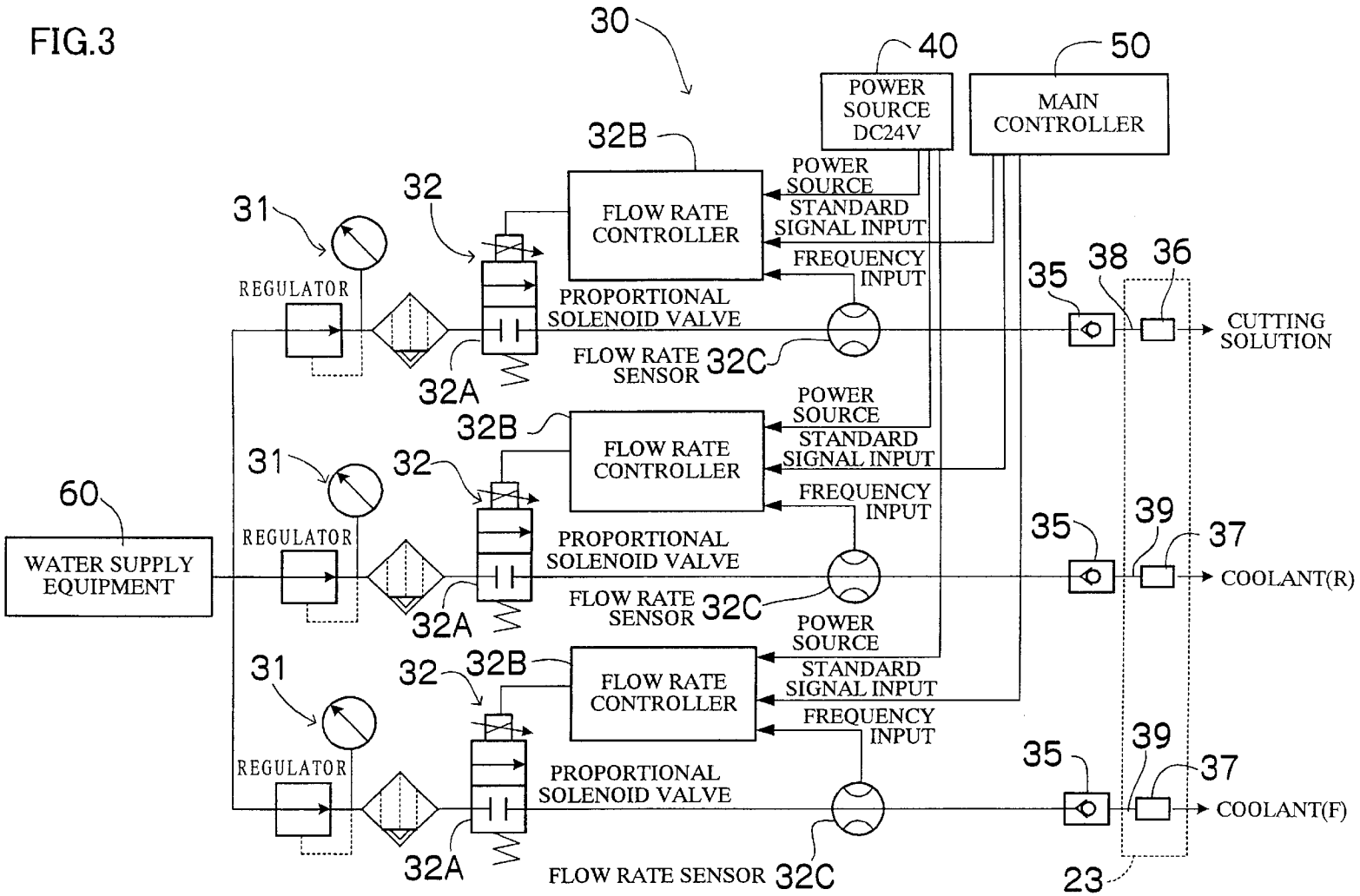
FIG. 3 is a block diagram of a cutting solution supplying and controlling apparatus according to an embodiment of the present invention.

FIG. 3 is a block diagram of the cutting solution supplying and controlling apparatus 30 according to the embodiment of the present invention. As shown in FIG. 3, the cutting solution supplying and controlling apparatus 30 has three water supply pipes of the cutting solution, the coolant (F) and the coolant (R) for each blade. The cutting solution is applied to the edge of the blade 22 so that the cutting solution is supplied to the processing portion. The coolant (F) and the coolant (R) are applied to the blade 22 from the front side (the side far from the spindle) of the blade 22 and the rear side (the side near the spindle) of the blade 22 so as to cool the blade 22. The water supplied from the water supply equipment 60 of the factory is divided into the three water supply pipes. Each water supply pipe has a regulator 31, which adjusts a pressure of the supplied water to the set pressure, and has a flow rate adjusting device 32, which adjusts the flow rate of the supplied water, next to the regulator 31. In the dicing machine, the set pressure is generally about 0.45 MPa and the flow rate is 1.0–1.2 liter per minute, which are different according to the processing specifications. The water of which the flow rate is adjusted is supplied through the check valve 35 and the cutting solution supplying pipe 38 to the cutting solution nozzle (the cutting solution), or is supplied through the coolant supplying nozzle 39 to the coolant nozzles 37 (the coolant (F) or the coolant (R)).

The flow rate adjusting device 32 comprises: a proportional solenoid valve 32A, with which the flow rate regulator 32 adjusts the flow rate of the supplied water to the set flow rate and changes ON/OFF of the water supply; a flow rate controller 32B, which controls the proportional solenoid valve 32A; and a flow rate sensor 32C, which measures the flow rate of the adjusted water. The flow rate controller 32B supplies a direct current (e.g., DC 24 V) from a power source 40 to the proportional solenoid valve 32A. The flow rate controller 32B controls the proportional solenoid valve 32A according to signals applied from a main controller 50 of the dicing machine 1 representing a set value of the flow rate and ON/OFF of the water supply. The flow rate controller 32B also controls the proportional solenoid valve 32A according to a value measured by the flow rate sensor 32C as a feedback signal, so that the flow rate of the supplied water is always at the set value.

Hereunder, operations of the above-described cutting solution supplying and controlling apparatus 30 are explained. Generally, the pressure of the water supplied from the water supply equipment 60 of the factory is reduced to the set pressure by the regulators 31, and the flow rates of the water are adjusted to the set flow rates by the proportional solenoid valves 32A. Then, the water is supplied through the check valves 35 and the cutting nozzle 36 and the coolant nozzles 37 to the blade 22 of the processing part 2. However, in the case where the pressure of the water supplied from the water supply equipment 60 of the factory falls so that the set pressure of the regulators 31 is not maintained, the flow rates is reduced less than the set values. In such an abnormal case, the flow rate sensors 32C detect the reduced flow rates, and the flow rate controllers 32B control the proportional solenoid valves 32A so that the flow rate sensors 32C can detect the set flow rates, and the fixed flows are thereby secured.

The cutting solution supplying and controlling apparatus 30 for the dicing machine according to the present embodiment functions as described above, and even if the pressure (generally, about 0.5–0.7 MPa) of the water supplied from the water supply equipment 60 of the factory changes, the set flow rates are secured by the flow rate adjusting devices 32 so that the flow rates of the supplied water do not change.

Next, the second embodiment of the present invention is described. The dicing machine 1 processes various kinds of works W. Characteristic information of each work W necessary for the dicing machine is automatically read from a bar code applied on each work W, and the read characteristic information is stored in a memory of the main controller 50. In the case of a semiconductor wafer for example, the characteristic information includes a size (diameter and thickness) of the wafer, an index of CH-1, an index of CH-2, a revolving speed of the spindle 21, a cutting depth, a cutting speed, a flow rate of the cutting solution, a flow rate of the coolant and information concerning an alignment. According to the above-described information, the main controller 50 of the dicing machine applies signals representing the flow rate of the cutting solution and the flow rate of the coolant for the corresponding type to the flow rate controllers 32B. Then, each of the flow rate controllers 32B adjusts the flow rate to the set flow rate with the proportional solenoid valve 32A, and controls the proportional solenoid valve 32A according to a signal applied from the flow rate sensor 32C as a feedback signal, so that the flow rate of the supplied water is always at the set value. Thus, the set values of the flow rates of the cutting solution and the coolant are automatically changed according to the processed work W.

In the second embodiment, the flow rate of the supplied water is automatically set, and complicated operations of the operator are unnecessary.

Next, the third embodiment of the present invention is described. In the third embodiment, the flow rates of the cutting solution and the coolant are changed according to the processing directions in processing of one work W. For example in grooving of the semiconductor wafer, when the wafer that has been grooved in a direction (CH-1) is further grooved in another direction (CH-2) perpendicular to the CH-1 direction, scraps are difficult to flow and contamination is easy to accumulate on the surface of the wafer, because there are the already processed grooves. Therefore, when the wafer is grooved in the CH-2 direction, it is necessary to increase the flow rate of the cutting solution. In such work W, the type information further includes a CH-1 flow rate of the cutting solution, a CH-1 flow rate of the coolant, a CH-2 flow rate of the cutting solution and a CH-2 flow rate of the coolant, and the set values of the flow rates are changed with the flow rate controllers 32B by the main controller 50.

In the third embodiment, the CH-1 flow rates and the CH-2 flow rates can be automatically changed, and complicated operations of the operator are unnecessary.

In the above-described embodiments, each of the flow rate adjusting devices 32 comprises the proportional solenoid valve 32A, the flow rate controller 32B and the flow rate sensor 32C; however, other existing members can be utilized to automatically set and control the flow rates.

According to the present invention, even if the pressure of the water supplied from the water supply equipment of the factory changes, the flow rate of the cutting solution can be controlled and maintained to the set flow rate. Thus, a stabilized processing quality can be always obtained.

The suitable flow rate of the cutting solution for the work W to be processed can be set automatically. Thus, the operator does not have to perform complicated operations, and efficiency of the operation of the dicing machine is improved.

The flow rate of the cutting solution can be automatically changed according to the directions of the grooving. Hence, contamination does not accumulate in the processed groove, and the cleanness on the surface of the work is improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A cutting solution supplying and controlling apparatus for a dicing machine, in which cutting solution is applied to a processing part of the dicing machine, the cutting solution supplying and controlling apparatus comprising:

a flow rate adjusting device which adjusts a flow rate of the cutting solution to be supplied, the flow rate adjusting device comprising:

a flow rate regulator which regulates the flow rate of the cutting solution to a set flow rate;

a flow rate sensor which detects the adjusted flow rate of the cutting solution; and a flow rate controller which controls the flow rate regulator, wherein the flow rate controller controls the flow rate regulator with a detected signal of the flow rate sensor as a feedback signal and maintains the flow rate of the cutting solution to the set flow rate;

wherein the dicing machine performs a first groove processing to groove the work in a first direction and a second groove processing to groove the work in a second direction;

wherein the flow rate of the cutting solution is differently set to each of the first processing and the second processing; and wherein the flow rate of the cutting solution is automatically changed according to the direction of the groove processing.

2. A cutting solution supplying and controlling apparatus for a dicing machine, in which cutting solution is applied to a processing part of the dicing machine, the cutting solution supplying and controlling apparatus comprising:

a flow rate adjusting device which adjusts a flow rate of the cutting solution to be supplied, the flow rate adjusting device comprising:

a flow rate regulator which regulates the flow rate of the cutting solution to a set flow rate;

a flow rate sensor which detects the adjusted flow rate of the cutting solution; and a flow rate controller which controls the flow rate regulator, wherein the flow rate controller controls the flow rate regulator with a detected signal of the flow rate sensor as a feedback signal and maintains the flow rate of the cutting solution to the set flow rate; and wherein the flow rate of the cutting solution is automatically set according to characteristic information of a work being processed in the dicing machine.

3. The apparatus according to claim 2, wherein:

the dicing machine performs a first groove processing to groove the work in a first direction and a second groove processing to groove the work in a second direction;

the flow rate of the cutting solution is differently set to each of the first processing and the second processing; and the flow rate of the cutting solution is automatically changed according to the direction of the groove processing.

* * * * *

UNITED STATES PATENT AND TRADEMARK OFFICE

CERTIFICATE OF CORRECTION

Figure 4:
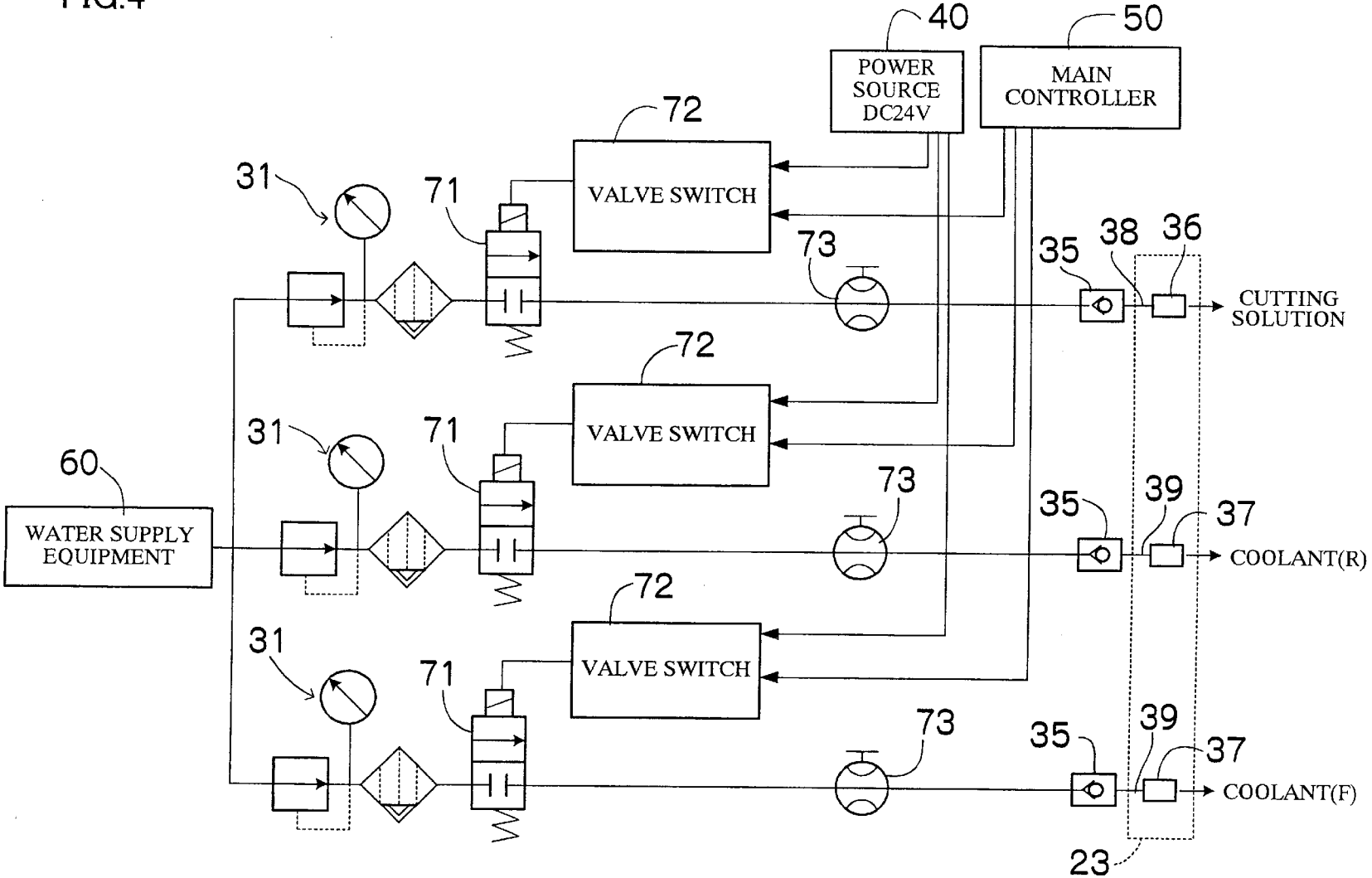
FIG. 4 is a block diagram of a cutting solution supplying and controlling apparatus for a dicing machine in the related art.
Figure 4:
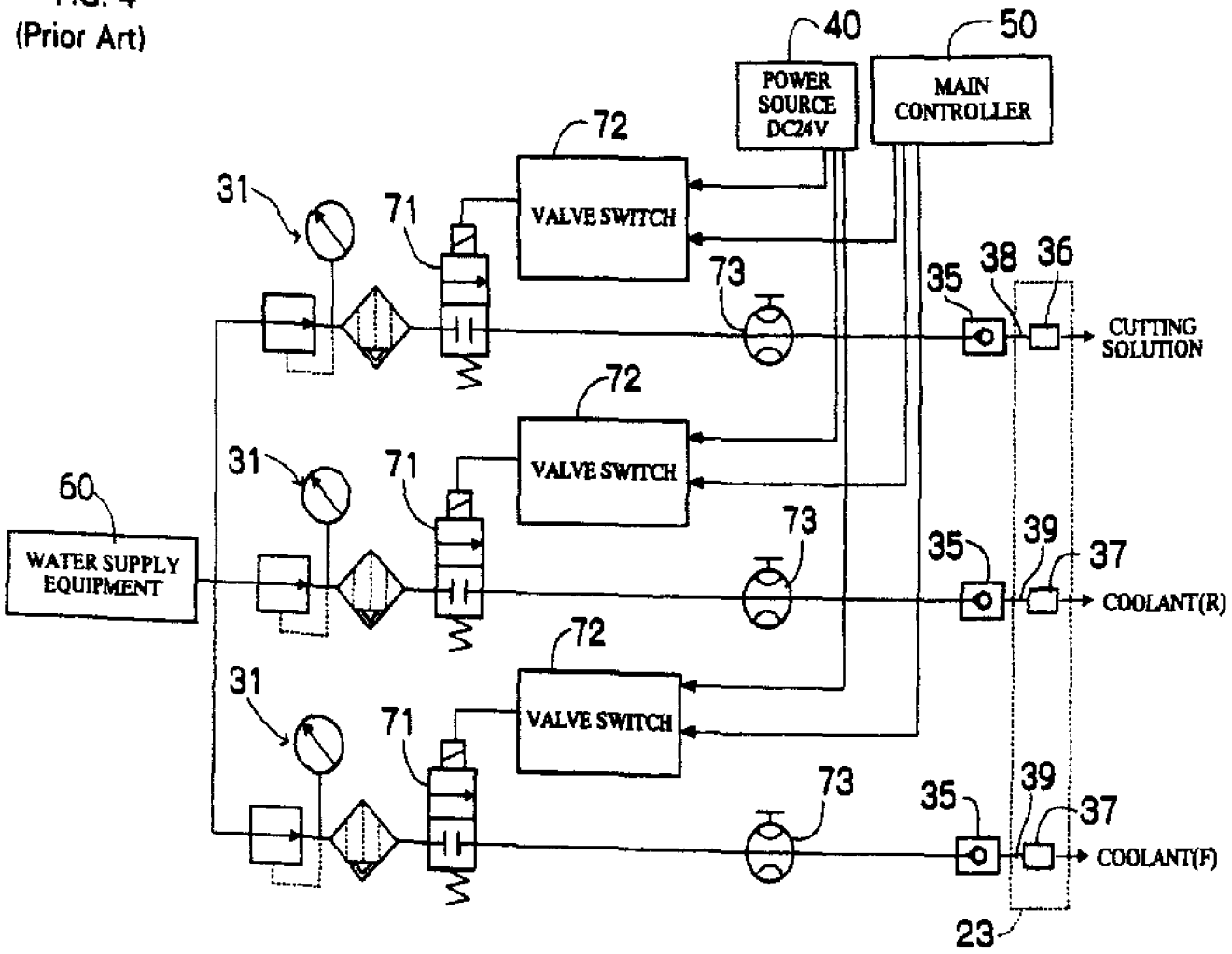
FIG. 4 (Prior Art)

PATENT NO. : 6,752,688 B2 
DATED : June 22, 2004
INVENTOR(S) : Tadashi Adachi, Masayuki Azuma and Takayuki Kaneko It is certified that error appears in the above-identified patent and that said Letters Patent is hereby corrected as shown below:

Drawings,
Please replace fig. 4 as follows

Signed and Sealed this

Nineteenth Day of April, 2005

JON W. DUDAS
*Director of the United States Patent and Trademark Office*